US005609809A

United States Patent [19]

Tanaka et al.

[11] Patent Number: 5,609,809

[45] Date of Patent: Mar. 11, 1997

[54] METHOD OF MANUFACTURING BIODEGRADABLE NONWOVEN FABRICS

[75] Inventors: Hiroshi Tanaka, Joyo; Yoshiki Miyahara, Uji; Satoshi Kasetani, Nara; Kouji Esaki, Matsudo; Shigetaka Nishimura, Uji; Takashi Inoue, Kawasaki, all of Japan

[73] Assignee: Unitika Ltd, Hyogo, Japan

[21] Appl. No.: 601,950

[22] Filed: Feb. 15, 1996

Related U.S. Application Data

[62] Division of Ser. No. 947,412, Sep. 18, 1992, Pat. No. 5,506,041.

[30] Foreign Application Priority Data

Sep. 26, 1991 [JP] Japan ..... 3-246360
Sep. 26, 1991 [JP] Japan ..... 3-246361

[51] Int. Cl.[6] ..... B29C 49/08

[52] U.S. Cl. ..... 264/210.7; 264/210.8; 264/211.14; 264/211.17

[58] Field of Search ..... 264/210.7, 210.8, 264/211.14, 211.17

[56] References Cited

U.S. PATENT DOCUMENTS

| | | | |
|---|---|---|---|
| 3,800,006 | 3/1974 | Katayama et al. . | |
| 4,306,552 | 12/1981 | Gregory | 128/156 |
| 4,496,508 | 1/1985 | Hartmmann et al. . | |
| 5,066,231 | 11/1991 | Oxman et al. | 433/214 |
| 5,100,435 | 3/1992 | Onwumere | 8/115.55 |
| 5,147,712 | 9/1992 | Miyahara et al. | 428/224 |
| 5,171,308 | 12/1992 | Gallagher et al. | 604/372 |
| 5,196,247 | 3/1993 | Wu et al. | 428/43 |

FOREIGN PATENT DOCUMENTS

| | | |
|---|---|---|
| 4016348 | 11/1991 | Denmark . |
| 0091785 | 10/1983 | European Pat. Off. . |
| 2519038 | 7/1983 | France . |

OTHER PUBLICATIONS

International Search Report Form PCT/ISA/210 Dated 14 January 1993 and Mailed 26 Jan. 1993.

Database WPIL, Section Ch, Week 2490, Derwent Publications Ltd., London, GB: Class A96, AN 90–182403 and JP–A–2 119 866 (Teijin), 7 May 1990.

Database WPIL, Section Ch, Week 1289, Derwent Publications Ltd., London, GB: Class A94, AN 89–090040 and JP–A–1 040,655 (Kuraray KK), 10 February 1989.

English Translation for DE–A–4 016348.

*Primary Examiner*—Christopher W. Raimund

*Attorney, Agent, or Firm*—Barnes, Kisselle, Raisch, Choate, Whittemore & Hulbert, PC

[57] ABSTRACT

A method of making a nonwoven fabric having biodegradability which can be advantageously used as a biodegradable material for general disposable-type household supplies represented by such items as sanitary materials, wiping cloths, and packaging materials. The nonwoven fabric is formed of a fiber material made of poly-ε-caprolactone and/or poly-β-propiolactone. The nonwoven fabric contains not less than 20% by weight of such a fiber material having a filament fineness of 0.8 to 6 denier. This provides sufficient tensile strength and soft hand which enable the nonwoven fabric to be advantageously used in practical applications. Where the nonwoven fabric is formed of a superfine fiber of the above noted type having a filament fineness of less than 0.8 denier, it has particularly remarkable soft hand.

4 Claims, 2 Drawing Sheets

METHOD OF MANUFACTURING BIODEGRADABLE NONWOVEN FABRICS

This is a divisional of application Ser. No. 07/947,412 filed on Sep. 18, 1992, now U.S. Pat. No. 5,506,041.

FIELD OF THE INVENTION

The present invention relates to nonwoven fabrics having biodegradability which can be advantageously used as a biodegradable material for general disposable-type household supplies represented by such items as sanitary materials, wiping cloths, and packaging materials, and a method of manufacturing same.

BACKGROUND OF THE INVENTION

Hitherto, nonwoven fabrics have been widely used as material for sanitary materials, general household supplies, and industrial supplies. Materials used as constituent fibers of such fabrics include, for example, polymers such as polyethylene, polypropylene, polyester, and polyamide. However, it must be pointed out that nonwoven fabrics made of such material are not self-degradable and are chemically very stable under normal environmental conditions. Therefore, is has been general practice that disposable type nonwoven fabrics, after use, are disposed by such a method as incineration or landfill disposal. In Japan, disposal by incineration is widely in practice which, however, involves great expenditure and results in environmental pollution due to waste plastics. Indeed, how to solve the problem of waste plastics disposal is becoming an object of great public concern from the standpoints of nature conservation and living-environment protection. Landfill disposal involves a problem that the waste will long remain unchanged in the ground from its original state because the material thereof is chemically stable.

In order to solve such a problem, it has been desired to produce a novel nonwoven fabric which is made from a degradable (i. e., microbially degradable or biodegradable) material and can be naturally degraded in a short time period.

Typically, examples of biodegradable fibers include cellulose fibers represented by cotton and linen and protein fibers represented by silk. Since these natural fibers are non-thermoplastic, however, it is impracticable to employ the so-called embossing technique or thermal bond technique in which fibers are thermally bonded together into a nonwoven fabric, for purposes of fabricating a nonwoven fabric from any such natural fiber. Any nonwoven fabric made from a natural fiber material would not become degraded in a short period of time and would continue to exist in its form as such. This is undesirable when considered in the interests of nature conservation and living-environment protection.

Biodegradable polymers are well known including polysaccharides, such as chitin; proteins, such as catgut and regenerated collagen; polypeptide (polyamino acid); microbial polyesters, such as poly-3-hydroxybutyrate, poly-3 -hydroxyvalylate, and poly-3-hydroxycaprolate, which are microbially produced in nature; and synthetic aliphatic polyesters, such as polyglycolide and polylactide. However, producing fibers of these polymers involves the limitation that the wet spinning technique be employed. Further, such fibers are very costly and this limits the applicability for use of the fibers to such a particular field as bioabsorbable sutures.

Recently, a biodegradable film has been proposed which comprises a blend of polyethylene and starch. Such a film is now used as material for shopping bags. However, this type of film cannot be said to be a biodegradable film in a primary sense of the term, because polyethylene will permanently remain undegraded. Indeed, it is no easy task to produce a fiber of such a blend which is applicable for use in fabricating a nonwoven fabric; and to date no starch-containing fiber has been proposed for production of nonwoven fabrics.

SUMMARY OF THE INVENTION

With the foregoing background situation in mind, the invention is intended to provide a nonwoven fabric which is easily biodegradable, highly flexible, and inexpensive, and a method of making same.

The present invention achieves the foregoing object, and the biodegradable nonwoven fabric in accordance with the invention comprises a fiber material made of poly-ε-caprolactone and/or poly-β-propiolactone.

Such a nonwoven fabric is well suited for use as material for general domestic supplies, such as sanitary supplies, wiping cloths and packaging materials, and after use, can be made to stand for degradation in any environment in which microorganisms are present. No special waste treatment is required. This provides good advantage from the standpoint of environmental protection.

Another form of biodegradable nonwoven fabric according to the invention comprises not less than 20% by weight of a fiber material made of poly-ε-caprolactone and/or poly-β-propiolactone and having a filament denier of 0.8 to 6.

Still another form of biodegradable nonwoven fabric according to the invention comprises not less than 20% by weight of a fiber material made of poly-ε-caprolactone and/or poly-β-propiolactone and having a filament denier of 0.8 to 6, and not more than 80% by weight of a natural fiber or cellulose fiber.

The poly-ε-caprolactone (hereinafter referred to as "PCL") and/or poly-β-propiolactone (hereinafter referred to as "PPL") is preferably such that it has a melt flow rate (g/10 min.) of not more than 45, more preferably not more than 30, as measured according to ASTM-D-1238 (E). A melt flow rate of more than 45 is undesirable, because the strength of the resultant fiber is relatively low, resulting in the production of a nonwoven fabric of lower strength. Especially where the invention is applied to short-fiber nonwoven fabrics, a PCL and/or PPL having a melt flow rate of not more than 20 should be used whereby it is possible to increase the strength of the short-fiber constituents.

In the foregoing description, the filament denier of PCL and/or PPL fiber as a constituent material of the nonwoven fabric is 0.8 to 6. This limitation to 0.8 to 6 denier is intended to allow the nonwoven fabric to have soft hand, a characteristic feature required of disposable diapers, sanitary supplies, such as cover stock and wiping cloths, and the like. Any filament denier greater than 6 is undesirable because it tends to produce rough hand in the nonwoven fabric. Similarly, any filament denier lower than 0.8 is undesirable because the spinnability is not good.

The above described nonwoven fabric contains not less than 20% by weight of PCL and/or PPL fiber. A PCL and/or PPL fiber content of less than 20% by weight is undesirable because the rate of degradability of the nonwoven fabric in the earth is so low that the nonwoven fabric will long continue to retain its form as such.

Fiber materials available for blend with the PCL and/or PPL fiber component of the nonwoven fabric include fibers of such polymers as polyethylene, polypropylene, polyester and polyamide, natural fibers, and cellulose fibers. For purposes of fiber mixing, it is possible to employ various methods including, for example, combination-mixing during the stage of melt spinning, short fiber mixing at the stage of web forming, and web laminating, whereby a mixed-fiber nonwoven fabric can be produced.

Especially where any natural fiber or cellulose fiber is used in combination with the PCL and/or PPL fiber, the PCL and/or PPL fiber and the natural or cellulose fiber can be easily mixed together and fabricated into a nonwoven fabric. This way of mixing is not suitable for the purpose of synthetic fiber mixing; the reason is that where a synthetic fiber is used in combination with the PCL and/or PPL fiber, the synthetic fiber component will long remain undegradable after the nonwoven fabric is buried in the earth, though the nonwoven fabric will not retain its form as such. In the present invention, therefore, it is more desirable to mix the PCL and/or PPL fiber with a natural fiber or cellulose fiber in the stage of web forming and to turn the mixture into a nonwoven fabric. Natural fibers or cellulose fibers useful in the practice of the invention refer to fibers which can be degraded and turned to clay in course of time after it is buried in the earth, and include, for example, natural fibers represented by cotton and linen, and cellulose fibers made from wood pulp, such as rayon.

In the above described mixture non-woven fabric, the proportion of PCL and/or PPL is not less than 20% by weight and the proportion of the natural fiber or cellulose fiber (hereinafter referred to as "natural fiber or the like") is not more than 80% by weight. The reason for this limitation is that the thermal bonding or thermal fusing technique can be effectively employed in making a nonwoven fabric containing the natural fiber or the like within such a proportional range. If the amount of the PCL and/or PPL fiber is less than 20% by weight, its binder effect relative to the natural fiber or the like is reduced and, as a consequence, the resulting nonwoven fabric is of such a low strength that it can hardly be put to practical use. When the spunlace process is employed, the use of PCL and/or PPL in mixture with the natural fiber or the like results in further improvement in the flexibility of the nonwoven fabric produced. It is essential in this connection that the proportion of the PCL and/or PPL be not less than 20% by weight, preferably not less than 30% by weight.

In the present invention, the nonwoven fabric should have a fabric weight of 10 to 150 g/m$^2$, preferably 10 to 100 g/m$^2$. If the fabric weight is more than 150 g/m$^2$, no satisfactory soft hand could be obtained with respect to the nonwoven fabric. Especically where no durability is required of the nonwoven fabric, a fabric weight of not more than 100 g/m$^2$ is preferred, because it gives greater effect of soft hand. A nonwoven fabric having a fabric weight of less than 10 g/m$^2$ is undesirable, because not only is such a nonwoven fabric difficult to fabricate, but it lacks uniformity in itself.

Nextly, the method of fabricating a nonwoven fabric containing not less than 20% by weight of a fiber material having a filament denier of 0.8 to 6 will be explained. Such a nonwoven fabric can be manufactured by employing three different methods. First, a so-called spun-bond method will be described.

This first method comprises the steps of melt-spinning PCL and/or PPL into a multifilament via spinnerets at temperatures of 100° to 220° C. above the melting point of the PCL and/or PPL, cooling to solidify the spun multifilament, then drawing and taking off the solidified multifilament at a suction-take off rate of more than 2000 m/min. through take-off means, such as a suction device, arranged at a position which is at least 100 cm beneath the spinnerets, then opening the multifilament and forming same into a web.

As a second method, a so-called spin-draw-spun-bond method may be employed. This method comprises the steps of melt-spinning PCL and/or PPL into a multifilament via spinnerets at temperatures of 100° to 240° C. above the melting point of the PCL and/or PPL, cooling to solidify the spun multifilament, then taking off the solidified multifilament at a take-off rate of more than 500 m/min., drawing the multifilament to a draw ratio of 1.5–3.5 between the take-off roll and the drawing roll disposed in succession thereto, then forming the drawn multifilament into a web.

As a third method, a so-called short-fiber method is employed. This method comprises the steps of melt-spinning PCL and/or PPL into a multifilament via spinnerets at temperatures of 100° to 220° C. above the melting point of the PCL and/or PPL, cooling to solidify the spun multifilament, then taking off the solidified multifilament at a take-off rate of more than 500 m/min., drawing the multifilament to a draw ratio of 2.0–3.5 between the take-off roll and the drawing roll disposed in succession thereto, then subjecting the drawn multifilament to mechanical crimping, cutting the filament into short fibers of a predetermined length, then forming same into a web.

In any of the above described methods of fabrication, the temperature at which the polymer is to be melt spun should be within a range of 200° to 300° C. which is 100° to 240° C. higher than the melting point of the PCL and/or PPL, and may be suitably selected within the aforementioned range and according to the melt flow rate of the PCL and/or PPL used. In the case where PCL and PPL are used in mixture, the melt spinning temperature may be experimentally determined so as to provide good spinnability on the basis of the respective melt flow rates of and an applicable mixture ratio of the polymers. If the spinning temperature is higher than 300° C., the PCL and/or PPL tends to become noticeably decomposed, while if the spinning temperature is lower than 200° C., some difficulty will be encountered in the process of extrusion utilizing a melt-extruder.

When the spun-bond method is employed in fabricating a nonwoven fabric, the position at which is arranged take-off means, such as an air suction device, should be at least 100 cm below the spinnerets. If the position is less distant from the spinnerets, some interfilament adhesion may occur and the spinnability may not be good. The process of drawing-taking-off is carried out so as to give a take-off rate of more than 2000 m/min. If the take-off rate is lower than 2000 m/min., the degree of orientation of the filament obtained is relatively low, resulting in lower filament strength, which naturally means lower nonwoven-fabric strength. Filaments thus obtained are collected and deposited onto a travelling endless net for being formed into a web. Individual filaments of the web are heat-bonded by means of a heated flat roll or embossing roll. A nonwoven fabric is thus produced.

When either the spin-draw-spun-bond method or the short fiber method is employed in fabricating a nonwoven fabric, multifilaments spun are taken off by means of a take-off roll, being then subjected to drawing between the take-off roll and a drawing roll disposed in succession to the take-off roll. For the purpose of drawing, a one-stage or two- or more-stage process of cold drawing or hot drawing is employed. For PCL drawing, drawing may be carried out at room temperature. For PPL or a PCL-PPL mixture, hot drawing may be effected at 40°–60 ° C. Where the spin-draw-spunbond method is employed, filaments are taken off at a take-off rate of more than 500 m/min., and drawing is carried out at a draw ratio of 1.5–3.5, whereby a fiber material having a tensile strength of more than 2.5 g/denier can be produced. This method is suitable especially where a high-viscosity polymer is used. In the case of short fibers, a total draw ratio of 2.0–3.5 may be employed, whereby a fiber material having a tensile strength of 3.0 g/denier can be produced.

Then, filaments are subjected to mechanical crimping by using a stuffer box or the like and are then cut into short fibers of a predetermined length. Then, the short fibers are fed to a carding machine or the like so as to be made into a web. In order to produce a nonwoven fabric from the fibers, the temperature for crimping operation is suitably selected considering the fact that the melting point of PCL is about 60° C. and that the melting point of PPL is about 100° C. The temperature should be 25° to 55° C. for PCL, and 80° to 95° C. for PPL. In the case of a PCL-PPL mixture, a suitable temperature is selected considering the respective melting points of PCL and PPL and the mixture ratio of the one to the other and so as to ensure that a nonwoven fabric can be obtained with good texture effect. Normally, however, a temperature range of 25° to 60° C. may be suitably used. To process the filaments into a nonwoven fabric, different methods may be employed which include the heat bonding method in which a heated flat roll or embossing roll is used, the heat welding technique represented by "thermal-through" utilizing hot air, the needle punch method, the spunlace process, and the ultrasonic bonding method. Where the heat bonding method is employed, the bonding temperature may be 47° to 57° C. for PCL, 85° to 97° C. for PPL, and 55° to 65° C. for PCL-PPL mixture. Where the heat welding method is employed, the welding temperature may be 47° to 60° C. for PCL, 85° to 100° C. for PPL, and 55° to 85° C. for PCL-PPL mixture. In the spunlace process, fine nozzles of 0.05 to 1.0 mm dia, flat nozzles having a similar sectional area, slit-form nozzles having a slit length to slit width ratio of about 100 to 5000, preferably about 500 to 2000, and a slit width of 0.02 to 0.06 mm, or the like are arranged in one or plural lines and water or warm water streams are jetted through them under a pressure of 5 to 200 $kg/cm^2$. A nonwoven fabric is also obtainable by employing the wet laid process in which uncrimped short fibers are formed into a web.

The sectional configuration of filaments and/or fibers is not limited to a round one, but may of course be varied, e.g., hollow, flat, or Y-shaped, according to the intended use of the filament or fiber.

In the nonwoven fabric of the invention, the mixture ratio of the PCL and/or PPL fiber to natural fiber or the like is such that the proportion of the PCL and/or PPL fiber is not less than 20% by weight and the proportion of the natural fiber or the like is not more than 80% by weight. This enables the adoption of the thermal bond process and of the heat welding process for nonwoven fabric forming operation. Good binder effect can thus be obtained for bond between the PCL and/or PPL fiber and the natural fiber or the like, so that a nonwoven fabric having sufficient strength for application in practical use can be produced. Where the spunlace process is employed, a nonwoven fabric having good flexibility can usually be obtained; and the use of the PCL and/or PPL fiber in mixture with other fiber component provides for further improvement in the flexibility of the nonwoven fabric.

Another form of biodegradable nonwoven fabric according to the invention comprises an ultrafine fiber material formed of PCL and/or PPL and having a filament denier of less than 0.8.

A further form of biodegradable nonwoven fabric according to the invention comprises not less than 10% by weight of a web of an ultrafine fiber material formed of PCL and/or PPL and having a filament denier of less than 0.8, and in lamination therewith, not more than 90% by weight of a web of a fiber material formed of PCL and/or PPL and having a filament denier of 0.8 to 6.

A still further form of biodegradable nonwoven fabric according to the invention comprises not less than 20% by weight of a web of an ultrafine fiber material formed of PCL and/or PPL and having a filament denier of less than 0.8, and in lamination therewith, not more than 80% by weight of a web of a natural fiber or a cellulose fiber.

Another method of fabricating a biodegradable nonwoven fabric in accordance with the invention comprises making a nonwoven fabric formed of PCL and/or PPL according to a meltblown process, wherein after a polymer of the PCL and/or PPL is melt-blown, drawing air streams are eliminated by means of a baffle plate, then cooling air is blown sidewise toward the meltblown material to cool the same, and then the cooled material is formed into a web.

For purposes of forming a nonwoven fabric of such ultrafine fibers, the PCL and/or PPL should preferably have a melt flow rate (g/10 min.) of more than 70 but less than 300, preferably more than 100 but less than 200, as measured according to ASTM-D-1238 (E). A melt flow rate of less than 70 or more than 300 is not desirable because it leads to troubles, such as filament breaks and melt polymer dropping occurring by filament breakage, and some difficulty in fine denier filament forming, which make it impracticable to produce ultrafine fibers in steady condition.

In such nonwoven fabrics formed of ultrafine fibers, the filament denier of the component PCL and/or PPL fiber is limited to less than 0.8. The reason for this is that the invention is intended to provide a material suitable for use in applications, such as disposable diapers, sanitary cover stocks, wiping cloths, and medical-aid and sanitary materials of which are required soft hand in particular, and that for such purposes a filament fineness of more than 0.8 denier is undesirable because it will result in rough hand with respect to the nonwoven fabric produced.

Since the nonwoven fabric is made of a PCL and/or PPL fiber, the nonwoven fabric is fast-degradable in the earth and will not long retain its form as such.

Where a strength of more than a certain degree is required of the nonwoven fabric, the nonwoven fabric may comprise a plurality of webs of a PCL and/or PPL fiber laminated together, or webs of the PCL and/or PPL fiber and other fibers laminated together. In making such laminated nonwoven fabric may be employed different laminating methods including, for example, a method wherein short fibers are blown in the stage of web forming, and another method wherein webs are laminated one over another.

Fiber materials available for above mentioned lamination with PCL and/or PPL include materials such as ployethylene, polypropylene, polyester, polyamide, natural and cellulose fibers. In the present invention, it is more desirable to laminate the web of PCL and/or PPL fibers with a natural fiber or cellulose fiber.

The reason why natural fibers or cellulose fibers are suitable for use is that synthetic fiber, if used in mixture with the PCL and/or PPL fiber, will not become degraded when buried in the earth, though it will not long retain its nonwoven fabric form. In the present invention, therefore, webs of the PCL and/or PPL fiber are laminated together, or a web of the PCL and/or PPL fiber and a web of a natural fiber or cellulose fiber are laminated together, into a nonwoven fabric. The term "natural fiber or cellulose fiber" used herein means a material which, when buried in the earth, will become degraded and return to the earth in course of time. Examples of such material include natural fibers represented by cotton and linen, and cellulose fibers, such as rayon produced from wood pulp. When webs of the PCL and/or PPL fiber are to be laminated together, one of the webs should have a filament denier of less than 0.8, while the other web should have a filament denier of 0.8 to 6. By limiting the filament fineness of the other web to 0.8 to 6 denier it is intended that a nonwoven fabric is provided which has soft hand sufficient to meet the characteristic requirements of disposable diapers, sanitary cover stocks, wiping cloths and the like and, in addition, sufficient strength characteristics effective for practical use.

A filament fineness of more than 6 denier is undesirable because it will result in the production of a nonwoven fabric having rough hand. Similarly, a filament fineness of less than 0.8 denier is undesirable, because it will result in a nonwoven fabric of lower strength than the required level which can hardly be put in practical use in any area of application in which product strength is required.

The lamination ratio of a web having a filament fineness of less than 0.8 denier should be such that the proportion of the web is not less than 10% by weight because if the proportion is less than 10% by weight, a nonwoven fabric having good air permeability and good flexibility cannot be obtained.

In the above described laminated nonwoven fabric comprising a web of PCL and/or PPL fiber and a web of a natural fiber or cellulose fiber ("natural fiber or the like"), the proportions of the respective webs are such that the proportion of the PCL and/or PPL fiber is not less than 20% by weight and that of the natural fiber or the like is not more than 80% by weight. By so limiting it is possible to employ the thermal bond process and the thermal welding process for purposes of nonwoven fabric making. If the proportion of the PCL and/or PPL fiber is less than 20% by weight, no sufficient binder effect can be provided with respect to the natural fiber or the like and the resulting nonwoven fabric is of lower strength, and can hardly be put in practical use. Where the spunlace process is employed, by mixing the PCL and/or PPL fiber with other fiber it is possible to obtain further improvement in the flexibility characteristics of the nonwoven fabric produced, but for this purpose it is essential that the proportion of the PCL and/or PPL fiber be not less than 20% by weight, preferably not less than 30% by weight.

It is preferred that the nonwoven fabric of the present invention should have a fabric weight of 5 to 50 g/m$^2$. If the fabric weight is more than 50 g/m$^2$, it is impracticable to obtain a nonwoven fabric having soft hand. A nonwoven fabric having a fabric weight of less than 5 g/m$^2$ is undesirable, because such a nonwoven fabric is not only impracticable to manufacture, but also it lacks uniformity in itself.

The nonwoven fabric of the invention comprises an ultrafine fiber material formed of the PCL and/or PPL fiber in the process of melt-blowing. As is well known, the meltblown process is a most simple and convenient method for fabricating a nonwoven fabric from an ultrafine fiber material which enables production of a nonwoven fabric having soft hand in particular. In the present invention, the method of forming an ultrafine filament according to the meltblown techinque is not particularly limited, it being possible to use such a conventional procedure as indicated hereinbelow. It is possible to employ a die, as disclosed in, for example, Japanese Patent Application Laid-Open No. 49-10258 or Japanese Patent Application Laid-Open No. 49-28921, in such a manner that a polymer is melt-blown through spinnerets having a pore diameter of 0.1 to 1.0 mm and, in this conjunction, an air stream jetting out at a velocity of 80 to 300 m/sec. and at a temperature of 20° C. higher than the temperature at the spinnerets is applied to the polymer at an angle of 5 to 45° relative to the the direction of polymer blowing, whereby the diameter of the blown polymer can be rapidly finer. In this connection, the melt-spinning temperature is preferably within the range of 170° to 310° C. and may be suitably selected according to the melt flow rate of the PCL and/or PPL used. Where PCL and PPL are used in mixture, a suitable spinning temperature may be experimentally determined so as to provide good spinning performance and on the basis of the melt flow rates of the respective polymers and the mixture ratio of the one to the other. Spinning temperatures above 310° C. are undesirable because PCL and/or PPL will become noticeably decomposed. Spinning temperatures below 170° C. are also undesirable because such temperatures will lead to difficulty in extruding operation at the melt extruder and frequent polymer-drop occurrences.

DESCRIPTION OF THE EMBODIMENTS

In the process of manufacturing a nonwoven fabric of the ultrafine fiber type according to the invention, a polymer stream cannot be collected in the form of a nonwoven fabric by any conventional method, because the melting point, as well as the crystallizing temperature, of PCL and/or PPL is slightly higher than or in the vicinity of room temperature. Conventionally, a polymer stream is collected as its is onto a conveyor or by means of a rotary drum after it is discharged from a die. In the case of the polymer(s) used in the present invention, by so doing it is only possible to find polymer collected in an insufficiently cooled condition such that the polymer is still almost in its melt state.

Figure 1:
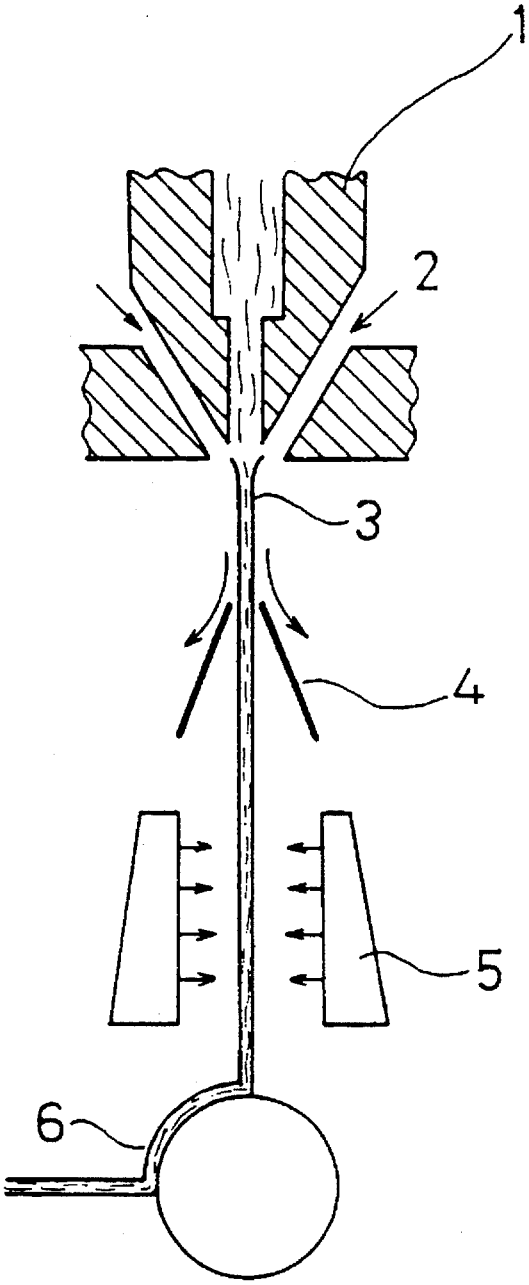
FIG. 1 is a view showing a die and adjacent arrangement in apparatus for manufacturing nonwoven fabrics formed of ultrafine fibers according to the invention.

Apparatus incorporating corrective measures in this regard is described in detail with reference to FIG. 1. A polymer stream 3 discharged from a die 1 is first yeilded fine fiber by hot air streams 2 blown from both sides thereof. For the purpose of subsequently eliminating the air streams, baffle plates 4 are disposed at a location spaced several to several tens of centimeters apart from the die 1. After air streams are eliminated by means of the baffle plates 2, cooling air currents controlled to a temperature below room temperature are blown from cooling air blow devices 5 arranged on both sides at a position a few centimeter distant from the baffle plates 4 to thereby cool the polymer stream 3, and then the cooled polymer is collected in the form of ultrafine fibers. The ultrafine fibers thus obtained are then collected in sheet form on to a net conveyor or the like for being formed into a fiber web 6 having a predetermined thickness and filament alignment. In the figure, the arrows indicate the directions of air flow. It is understood that the invention is not limited to the FIG. 1 arrangement; alternatively the arrangement may be such that polymer is meltblown sideways. The fiber material obtained in this way has a mean filament diameter of about 0.5 to 1.0 μm. This provides soft hand, and proportional increase in the fiber surface area, which is advantageous from the standpoint of biodegradability in that the larger surface area can enhance microbial degradation.

The nonwoven fabric of the invention may be a single layer nonwoven fabric produced by the meltblown process as above described, or may be a nonwoven fabric comprising plural layers of nonwoven fabrics produced by the meltblown process which are laminated one over another. Alternatively, the nonwoven fabric of the invention may comprise a nonwoven fabric of PCL and PPL produced as by the spun-bond method or short fiber method and, in lamination therewith, a nonwoven fabric of a natural fiber or cellulose fiber produced as by the short fiber method. In the process of lamination, constituent fibers may be interlocked through application of high pressure water streams, or may be subjected to thermal bonding by an embossing roll or the like. Treatment by the spunlace process is effected as earlier mentioned. For purposes of interfiber thermal bonding, a pair of embossing rolls or a set of rolls including an embossing roll and a flat roll may be employed.

The nonwoven fabric in accordance with the invention has excellent biodegradability and, when buried in the earth, it may become degraded in about two months to the extent that it no longer has a trace of its original form.

The nonwoven fabric of the invention can also be produced by laminating webs of PCL and/or PPL fibers together, or by laminating a web of PCL and/or PPL fiber and a web of other fiber, such as a natural fiber, as stated earlier. One method of lamination is that a web of PCL and/or PPL fiber and a web of other fiber are placed one over the other and then the constituent fibers are interlocked by being subjected to high pressure water streams. Another method may be that apparatus as shown in FIG. 2 is employed in such a way that during the process of making PCL and/or PPL ultrafine fibers, a stream of said other fiber is blown toward the PCL and/or PPL fiber stream and the resulting mass is collected by means of a net, whereby a laminated nonwoven fabric can be obtained.

Figure 2:
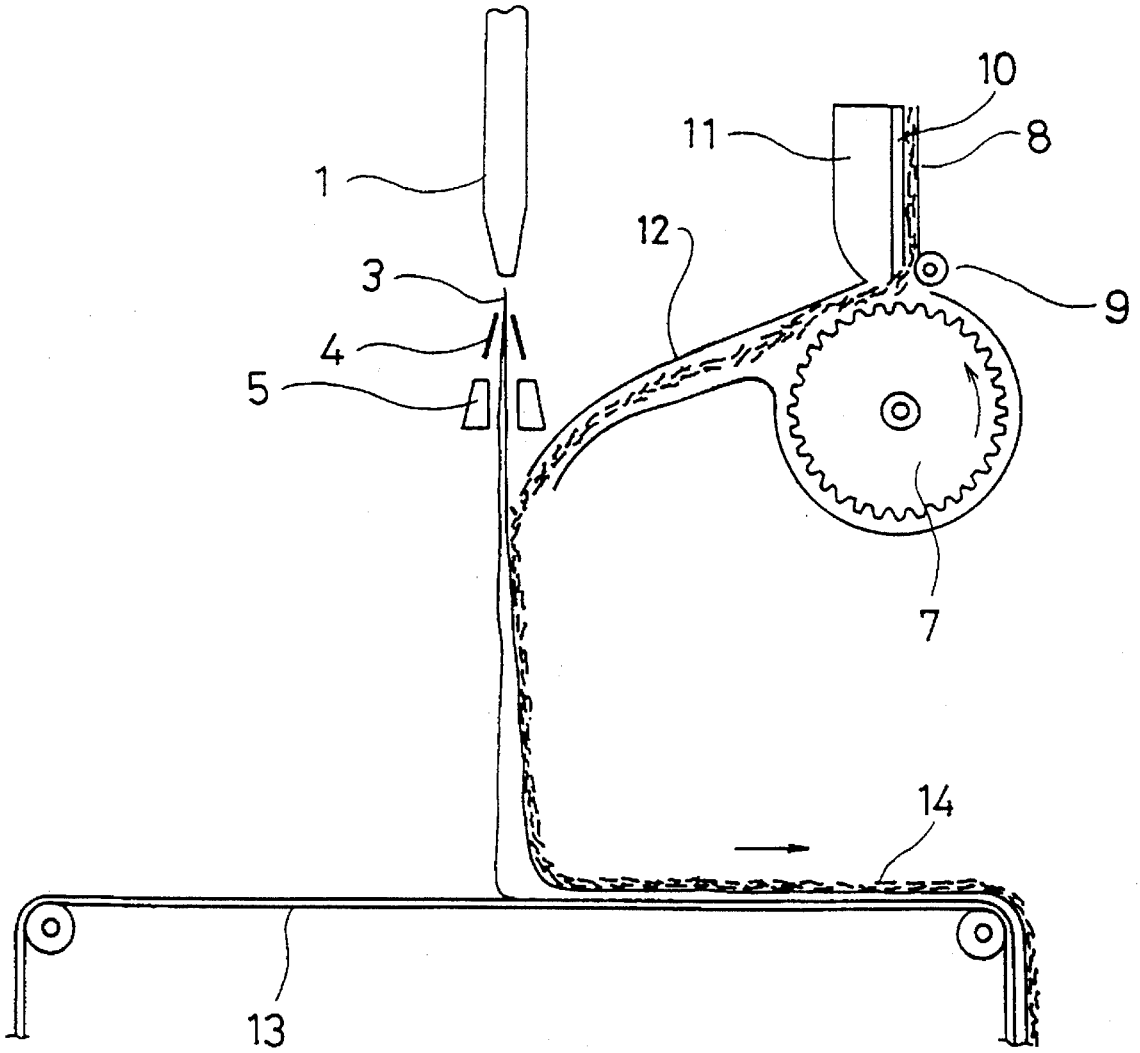
FIG. 2 is a view schematically showing general arrangement of apparatus for making nonwoven fabrics formed of ultrafine fibers of the invention.

In the laminating apparatus shown in FIG. 2, a "Ritzen" roll 7 disposed at a location spaced laterally from the die 1 of the meltblow apparatus is operated to introduce a stream of the fiber to be laminated into an ultrafine fiber stream 3. A web 8 may be made by, for example, a garnet machine or a Randowebber. The web 8 is advanced along a table 10 disposed adjacent a drive roll 9 so that its leading end comes into engagement with the "Ritzen" roll 7. The "Ritzen" roll 7 rotates in the direction of the arrow to scrape fibers from the leading end of the web 8. Scraped fibers are conveyed in an air stream through a conduit 12 until they join an ultrafine fiber stream into which polymer stream 3 is converted. Resulting joined masses are deposited on a net conveyor 13, and the earlier mentioned scraped fibers and ultrafine fibers are laminated together into a laminated web 14. Aforesaid air stream may be generated through revolution of the "Ritzen" roll 7 or by introducing air from an air blast port 11 as shown.

In the process of lamination, the proportion of the PCL and/or PPL ultrafine fiber should be not less than 20% by weight. If the proportion is less than 20% by weight, the resulting nonwoven fabric will have rather poor hand when lamination is effected by the spunlace process. Where spraying operation is carried out in producing a laminated nonwoven fabric, such a low proportion of the PCL and/or PPL ultrafine fiber is undesirable because it results in poor interfiber bond effect, thus resulting in low fabric strength.

Examples of the invention will now be described in detail.

The melt flow rate (hereinafter referred to as "MFR") of the PCL and/or PPL as applied with respect to each of the following examples was measured according to ASTM-D-1238 (E). The melting point was measured by employing a DEC-7 type apparatus made by Perkin Elmer and at a heating-up rate of 20° C. In measuring tensile strength with respect to respective nonwoven fabrics shown in the following examples, a test specimen having a width of 3 cmm and a length of 10 cm was used and the same was tested for measurement of maximum tensile strength at a pull rate of 10 cm/min. according to the strip method described in JIS-L-1096. Initial tensile strength shown with respect to each example was measured, after measurement of fabric weight thereof for purposes of comparison in terms of 30 $g/m^2$, according to the following equation:

$$\text{Initial tensile strength (g/3 cm)} = 30 \times \text{tensile strength (g)/fabric weight (g/m}^2\text{)}$$

The flexibility of each nonwoven fabric was indicated in terms of softness. For purposes of measuring softness, a test specimen having a width (longitudinal) of 5 cm and a length 10 cm (lateral) was laterally bent into a cylinder form, with ends thereof bonded together, which was used as test sample. The cylindrical test sample was longitudinally compressed at a compression rate of 5 cm/min. by using a "Tensilon UTM-4-100" type apparatus made by Rheometrics Co., Ltd. Softness represents the value of stress at maximum load as measured during the process of compression. The smaller the value of stress, the better is the softness. In evaluation of the measurements, any softness value of more than 70 g was rated "no good" according to general criterion of judgment.

For evaluation of biodegradability, nonwoven fabrics which had been buried in the earth for three months were taken out, each being examined whether or not it was still retaining its form. Where a nonwoven fabric was found as retaining its form but its tensile strength had decreased to a level below 50% of the initial value, the nonwoven fabric was judged to be satisfactory in respect of biodegradability. Where a nonwoven fabric was found good in respect of biodegradability but its initial tensile strength (in terms of 30 $g/m^2$ of fabric weight) was less than 1000 g/3 cm, it was rated no good in general evaluation.

EXAMPLE 1

A PCL having a melting point of 59° C. and an MFR of 25 g/10 min. was used. Melt-spinning was carried out at a spinning temperature of 230° C. by employing a plurality of nozzle packs each having 84 orifices of 0.35 mm dia. each. Continuous multifilament spun was drawn and taken off by means of an air sucker device disposed 150 cm below a nozzle plate, under varied air pressures and at varied suction-take off rates. The multifilament was opened, collected and deposited on a moving endless net so as to form a web. Subsequently, the web was subjected to heat treatment by being passed through a heated embossing roll and a flat metal roll, under the conditions of: a load of 40 kg/linear-cm, compacting area of 17% and heat treating temperature of 57° C. Thus, a spun-bond nonwoven fabric having a fabric weight of 30 $g/m^2$ was obtained. For purposes of spinning, the amount of polymer discharge was adjusted for each test so as to give a filament of such filament fineness as specified in FIG. 1. Each nonwoven fabric thus obtained was evaluated as to its strength, softness, and biodegradability. The results are shown in Table 1.

TABLE 1

| No. | Take-off rate m/min | Filament denier d. | Initial tensile strength g/3 cm | Softness g | bio-degrad-ability | General evaluation |
|---|---|---|---|---|---|---|
| 1 | 3500 | 2 | 2420 | 8 | good | good |
| 2 | 3500 | 4 | 2400 | 30 | good | good |
| 3 | 3500 | 6 | 2110 | 65 | good | good |
| 4 | 3500 | 8 | 1840 | 102 | — | no good |
| 5 | 3000 | 1 | 1660 | 6 | good | good |
| 6 | 2400 | 3 | 1500 | 18 | good | good |
| 7 | 1500 | 3 | 860 | — | — | no good |

As is apparent from Table 1, in Example Nos. 1 to 3, 5 and 6 of the invention, the respective nonwoven fabrics were all satisfactory in strength, softness, and biodegradability. In Example No. 4 in which filament denierage was excessively high, the nonwoven fabric obtained was of unsatisfactory texture and rough hand. In No. 7 in which take-off rate was too slow, the nonwoven fabric obtained was of low initial tensile strength and was found unsuitable for use in practical application.

Reference Example 1

Spinning was carried out at a spinning temperature of 180° C., with take-up rate of 3500 m/min., and under same conditions as Example 1. However, the filament spun suffered frequent breaking and accordingly any nonwoven fabric could not be obtained.

Spinning temperature was set at 230° C., and the air sucker device was disposed 80 cm below the spinnerets. Spinning was carried out at take-off rate in same way as in Example 1. However, interfilament adhesion occurred and no nonwoven fabric could be obtained.

EXAMPLE 2

A PCL having an MFR of 13 g/10 min. was used. A plurality of nozzle packs each having 300 orifices of 0.5 mm dia. each were employed. Melt-spinning was carried out at a spinning temperature of 260° C. Winding was carried out at a winding speed of 400 and 1,000 m/min., respectively, and undrawn filaments were thus obtained. A plurality of undrawn filament packages obtained were doubled and were drawn at such a draw ratio as shown in Table 2. After subjected to mechanical crimping in a stuffer box, the drawn filament was cut to a fiber length of 51 mm. Thus, PCL short fibers having a fiber fineness of 3 denier and 23 crimps per inch were obtained.

TABLE 2

| No. | Winding Speed m/min | Draw ratio | Fiber strength g/d | Spinnability |
|---|---|---|---|---|
| A | 400 | 2.5 | 3.4 | Good |
| B | 1000 | 3.0 | 4.3 | Good |
| C | 1000 | 1.8 | 3.1 | Good |
| D | 1000 | 4.0 | — | freq. breaking |

For purposes of spinning, the rate of polymer discharge was adjusted considering the winding speed and draw ratio so that a short fiber fineness of 3 denier could be obtained. In the process of web making, a parallel carding machine was employed and a 100% PCL short-fiber web and a mixture web having a rayon component of 3 denier were produced, both being supplied to the process of nonwoven fabric making. With respect to PCL short fiber-rayon mixture webs, type of PCL short fibers and the mixture ratio (wt %) were varied as shown in Table 3.

For purposes of nonwoven fabric making, the heat bond process and spunlace process were employed with respect to webs having different mixture ratios as shown in Table 3. In the heat bond process, a heated embossing metal roll and a flat metal roll were employed to give heat treatment under the conditions of: a load of 30 kg/linear-cm, compacting area of 20% and a heat treating temperature of 55° C. Thus, nonwoven fabrics each having a fabric weight of 30 g/m$^2$ were obtained. In the spunlace process, webs were treated by high pressure water streams of 35 kg/cm$^2$ from nozzles having an orifice diameter of 0.1 mm and arranged at a pitch of 2.5 mm, and thus nonwoven fabrics each having a fabric weight of 40 g/m$^2$ were obtained. The nonwoven fabrics were each evaluated in respect of strength, softness and biodegradability. The evaluation results are shown in Table 3.

TABLE 3

| No. | Short fiber used | Nonwoven fabric making | Mixing ratio PCL/rayon | Initial tensile strgth. g/3 cm | Softness g | biodegradability | General evaluation |
|---|---|---|---|---|---|---|---|
| 1 | A | heat bond | 100/0 | 800 | 10 | — | no good |
| 2 | B | heat bond | 100/0 | 1140 | 8 | good | good |
| 3 | C | heat bond | 100/0 | 1070 | 6 | good | good |
| 4 | B | heat bond | 70/30 | 1290 | 17 | good | good |
| 5 | B | heat bond | 50/50 | 1250 | 30 | good | good |
| 6 | B | heat bond | 30/70 | 1100 | 53 | good | good |
| 7 | B | heat bond | 10/90 | 620 | 85 | — | no good |
| 8 | B | spunlace | 100/0 | 1470 | 6 | good | good |
| 9 | B | spunlace | 70/30 | 1520 | 10 | good | good |
| 10 | B | spunlace | 50/50 | 1680 | 22 | good | good |
| 11 | B | spunlace | 30/70 | 1600 | 38 | good | good |
| 12 | B | spunlace | 10/90 | 1610 | 75 | — | no good |
| 13 | B | spunlace | —/100 | 1550 | 80 | — | no good |

As is clear from Table 3, in Example Nos. 2 to 6, and 8 to 11 of the invention, nonwoven fabrics obtained were all satisfactory in strength and biodegradability, and had soft hand. However, in Nos. 1, 7, 12 and 13 in which the proportion of PCL short fibers was too small, nonwoven fabrics obtained were unsatisfactory either in strength (too low) or in softness.

EXAMPLE 3

A PPL having a melting point of 101° C. and an MER of 25 g/10 min was used, and a plurality of nozzle packs each having 84 orifices of 0.35 mm dia. each were employed. Melt-spinning was carried out at a spinning temperature of 250° C. Filaments spun were taken off at such take-off rate as shown in Table 4. Then, drawing was carried out at such draw ratio as shown in Table 4 and at a temperature of 50° C. In this conjunction, the rate of polymer discharge was adjusted so as to give a filament of 4 denier. Subsequently, heat treatment was given by employing a heated embossing metal roll and a flat metal roll under the conditions of: a load of 20 kg/linear cm, compacting area of 17% and a heat treating temperature of 95° C. Thus, spun-bond nonwoven fabrics each having a fabric weight of 30 g/m$^2$ were obtained. Respective strength and softness values of the nonwoven fabrics are shown in Table 4.

TABLE 4

| No. | Take-off m/min | Draw ratio | Initial tensile strength g/3 cm | Softness g | bio-degrad-ability | General evaluation |
|---|---|---|---|---|---|---|
| 1 | 300 | 3.5 | 750 | 8 | good | no good |
| 2 | 1000 | 1.8 | 1720 | 16 | good | good |
| 3 | 1000 | 2.4 | 2200 | 28 | good | good |
| 4 | 1000 | 3.7 | — | — | — | breaks |

As is clear from Table 4, in Example Nos. 2 and 3 of the invention, the nonwoven fabrics were satisfactory in strength and biodegradability, and had soft hand.

EXAMPLE 4

A PCL having an MFR of 20 g/10 min and a PPL having an MFR of 25 g/10 min were used in the form of chips and in a mixture ratio of 50/50. A plurality of nozzle packs each having 84 orifices of 0.35 mm dia. each were emplyed. Melt spinning was carried out at a discharge rate of 1.5 g /min/hole and at a spinning temperature of 250° C. Continuous multifilaments spun were drawn and taken off through air suckers disposed 150 cm below the nozzle plate at a suction take-off rate of 3500 m/min. A multifilament having a filament deneir of 4 was thus obtained. The multifilament was opened, collected and deposited on a moving endless mesh, being thereby formed into a web. Subsequently, the web was subjected to heat treatment by being passed through a heated embossing metal roll and a flat metal roll under the conditions of: a load of 20 kg/linear-cm, compacting area of 17% and a heat treating temperature of 60° C. A spun-bond nonwoven fabric having a fabric weight of 30 g/m$^2$ was thus obtained. The nonwoven fabric had a strength of 2480 g/3 cm and a softness of 33 g, and was found satisfactory in biodegradability.

In the following Examples, the thickness of each respective nonwoven fabric was measured according to the method described in JIS-L-1096 such that sample piece was subjected to a pressure of 100 g/cm$^2$ and was allowed to stand for 10 sec before measurement was made.

The bulkiness of each nonwoven fabric was determined on the basis of its weight and thickness and according to the following equation. The higher the bulkiness, the lower is the porosity of the nonwoven fabric. In evaluation, a nonwoven fabric having a bulkiness of 0.150 g/cm was judged satisfactory in respect of low porosity characteristics.

$$\text{Bulkiness (g/cm}^3\text{)=fabric weight (g/m}^2\text{)/(thickness (mm)}\times 1000)$$

The air permeability of each nonwoven fabric was measured according to the Frazir method as described in JIS-L-1096. In evaluation, a nonwoven fabric having an air permeability of more than 5 cc/cm$^2$/sec. was judged to be satisfactory.

EXAMPLE 5

A PCL having an MFR of 200 was used. By employing an extruder type melt spinning apparatus, the PCL was melt spun at a spinning temperature of 230° C., with a discharge rate of 80 g/min from a die having 200 orifices of 0.15 mm dia. each. In this connection, an air stream having a 30° C. higher temperature than the temperature of the die was applied to the polymer stream at a velocity of 170 m/sec. and at an angle of 25 degrees relative to the direction of polymer discharge.

In this conjunction, baffle plates for eliminating air streams were disposed 15 cm beneath the die and cooling air at 10° C. was blown sidewise toward the polymer stream at a location 5 cm beneath the baffle plates. Filaments were collected on a net conveyor provided 40 cm beneath the die and were thereby formed into a web. For this purpose, adjustment was made so as to give a web weight of 30 g/m$^2$.

Spinnability was satisfactory for purposes of nonwoven fabric making, and the resulting nonwoven fabric had an initial tensile strength of 750 g/3 cm, a bulkiness of 0.200 g/cm$^3$, and an air permeability of 15 cc/cm$^2$/sec, and was found satisfactory in biodegradability.

EXAMPLE 6

A PPL having an MFR of 160 was used. By employing an extruder type melt spinning apparatus, the PPL was melt spun at a spinning temperature of 270° C., with a discharge rate of 80 g/min from a die having 200 orifices of 0.15 mm dia. each. In this connection, an air stream having a 30° C. higher temperature than the temperature of the die was applied to the polymer stream at a velocity of 170 m/sec. and at an angle of 25 degrees relative to the direction of polymer discharge.

In this conjunction, as was the case with Example 5, baffle plates for eliminating air streams were disposed 15 cm beneath the die and cooling air at 10° C. was blown sidewise toward the polymer stream at a location 5 cm beneath the baffle plates. Filaments were collected on a net conveyor provided 45 cm beneath the die and were thereby formed into a web. For this purpose, adjustment was made so as to give a web weight of 30 g/m$^2$.

Spinnability was satisfactory for purposes of nonwoven fabric making, and the resulting nonwoven fabric had an initial tensile strength of 870 g/3 cm, a bulkiness of 0.231 g/cm$^3$, and an air permeability of 12 cc/cm$^2$/sec, and was found satisfactory in biodegradability.

EXAMPLE 7

50 parts by weight of PCL having an MFR of 200, and 50 parts by weight of PPL having an MFR of 160 were mixed in chip form. By employing an extruder type melt spinning apparatus, the mixture was melt spun at a spinning temperature of 255° C., with a discharge rate of 80 g/min from a die having 200 orifices of 0.15 mm dia. each. In this connection, an air stream having a 30° C. higher temperature than the temperature of the die was applied to the polymer stream at a velocity of 170 m/sec. and at an angle of 25 degrees relative to the direction of polymer discharge.

Subsequently, cooling was effected in the same way as in Example 1, and then fiber was collected on a net conveyor provided 40 cm beneath the die, a web being thus formed. For this purpose, adjustment was made to give a web weight of 30 g/m$^2$.

Spinnability was satisfactory for purposes of nonwoven fabric making, and the resulting nonwoven fabric had an initial tensile strength of 810 g/3 cm, a bulkiness of 0.188 g/cm$^3$, and an air permeability of 10 cc/cm$^2$/sec, and was found satisfactory in microbial degradability.

EXAMPLE 8

A PCL having an MFR of 25 was used. A plurality of nozzle packs each having 82 orifices of 0.35 mm dia each were employed. Melt spinning was carried out at a spinning temperature of 230° C. Continuous multifilaments spun were drawn and taken off through an air suction device arranged at a position 150 cm beneath the nozzle plate, at a suction-take off rate of 3500 m/min. The rate of polymer discharge was adjusted to give a multifilament having a filament denier of 2. A web having a weight of 40 g/m$^2$ was obtained through opening-collection-deposition on a moving net conveyor. Subsequently, PCL fibers having an MFR of 200 were laminated on the web by being blown according to the melt blown process. Conditions for meltblown were same as those in Example 5, with adjustment being made to give a web weight of 10 g/m$^2$. The laminated web was heat treated under the conditions of: a load of 40 kg/linear-cm, compacting area of 17% and heat treating temperature of 57° C. A laminated nonwoven fabric having a fabric weight of 50 g/m$^2$ was thus obtained.

The laminated nonwoven fabric had an initial tensile strength of 2200 g/3 cm, a bulkiness of 0.185 g/cm$^3$, and an air permeability of 16 cc/cm$^2$/sec, and was found satisfactory in microbial degradability.

EXAMPLE 9

A PCL having an MFR of 200 g/10 min. was used. A PCL web having a web weight of 15 g/m$^2$ was made in the same way as in Example 5. Subsequently, a parallel card web having a web weight of 35 g/m$^2$ which was formed of rayon short fibers of 2 denier with a a fiber length of 51 mm was laminated on the PCL web, a laminated web being thus prepared. The laminated web was treated with high pressure water streams of 40 kg/cm$^2$ jetted from nozzles each having an orifice of 0.1 mm dia and arranged at a 2.5 mm pitch, and a nonwoven fabric having a fabric weight of 50 g/m$^2$ was thus obtained. The nonwoven fabric had an initial tensile strength of 1800 g/3 cm, a bulkiness of 0.190 g/cm$^3$, and an air permeability of 50 cc/cm$^2$/sec, and was found satisfactory in biodegradability.

What is claimed is:

1. A method of manufacturing a biodegradable nonwoven fabric which comprises the steps of melt-spinning poly-ε-caprolactone and/or poly-β-propiolactone into a multifilament via spinnerets at temperatures of 100° to 240° C. above the melting point of the poly-ε-caprolactone and/or poly-β-propiolactone, cooling to solidify the spun multifilament, then drawing and and taking off the solidified multifilament at a suction-take off rate of more than 2000 m/min. through take-off means arranged at a position which is at least 100 cm beneath the spinnerets, then opening the multifilament and forming same into a web.

2. A method of manufacturing a biodegradable nonwoven fabric which comprises the steps of melt-spinning poly-ε-caprolactone and/or poly-β-propiolactone into a multifilament via spinnerets at temperatures of 100° to 240° C. above the melting point of the poly-ε-caprolactone and/or poly-β-propiolactone, cooling to solidify the spun multifilament, then taking off the solidified multifilament at a take-off rate of more than 500 m/min., drawing the multifilament to a draw ratio of 1.5–3.5 between the take-off roll and the drawing roll disposed in succession thereto, then forming the drawn multifilament into a web.

3. A method of manufacturing a biodegradable nonwoven fabric which comprises the steps of melt-spinning poly-ε-caprolactone and/or poly-β-propiolactone into a multifilament via spinnerets at temperatures of 100° to 240° C. above the melting point of the poly-ε-caprolactone and/or poly-β-propiolactone, cooling to solidify the spun multifilament, then taking off the solidified multifilament at a take-off rate of more than 500 m/min., drawing the multifilament to a draw ratio of 2.0–3.5 between the take-off roll and the drawing roll disposed in succession thereto, then subjecting the drawn multifilament to mechanical crimping, cutting the filament into short fibers of a predetermined length, then forming same into a web.

4. A method of manufacturing a biodegradable nonwoven fabric which comprises making a nonwoven fabric of poly-ε-caprolactone and/or poly-β-propiolactone according to a meltblown process, wherein after a polymer of the poly-ε-caprolactone and/or poly-β-propiolactone is melt blown from a die, drawing air streams are eliminated by means of a baffle plate, then cooling air is blown sidewise toward the meltblown material to cool the same, and then the cooled material is formed into a web.

* * * * *